US005408975A

United States Patent [19]

Blakeslee et al.

[11] Patent Number: 5,408,975

[45] Date of Patent: Apr. 25, 1995

[54] PRIMING CONTROL SYSTEM FOR FUEL INJECTED ENGINES

[75] Inventors: Wesley A. Blakeslee, Badger; Richard A. Fredrickson, Roseau, both of Minn.

[73] Assignee: Polaris Industries L.P., Minneapolis, Minn.

[21] Appl. No.: 57,645

[22] Filed: May 5, 1993

[51] Int. Cl.[6] ..... F02M 51/00

[52] U.S. Cl. ..... 123/491

[58] Field of Search ..... 123/491, 480, 487, 479, 123/481, 198 D, 421, 1 A, 478; 364/431.05, 431.09

[56] References Cited

U.S. PATENT DOCUMENTS

| | | | |
|---|---|---|---|
| 4,144,864 | 3/1979 | Kato et al. | 123/198 F |
| 4,328,547 | 5/1982 | Barman et al. | 364/431.09 |
| 4,354,239 | 10/1982 | Kanegae | 364/431.05 |
| 4,397,282 | 8/1983 | Salway | 123/487 |
| 4,492,197 | 1/1985 | Yamamoto et al. | 123/630 |
| 4,594,968 | 6/1985 | Degobert et al. | 123/1 A |
| 4,635,200 | 1/1987 | Egami et al. | 364/431.05 |
| 4,635,607 | 1/1987 | Yasuoka et al. | 123/479 |
| 4,682,293 | 7/1987 | Goldenberg et al. | 364/431.05 |
| 4,691,680 | 9/1987 | Staerzl | 123/491 |
| 4,706,630 | 11/1987 | Wineland et al. | 123/478 |
| 4,844,039 | 7/1989 | Osaki et al. | 123/491 |
| 4,890,590 | 1/1990 | Iwamoto et al. | 123/198 D |
| 4,979,480 | 12/1990 | Daikoku et al. | 123/478 |
| 5,009,211 | 4/1991 | Kushida et al. | 123/491 |
| 5,038,740 | 8/1991 | Tachibana et al. | 123/491 |
| 5,074,271 | 12/1991 | Suzuki et al. | 123/491 |
| 5,092,301 | 3/1992 | Ostdiek | 123/480 |
| 5,097,811 | 3/1992 | Baumuller | 123/481 |
| 5,205,255 | 4/1993 | Yamagata et al. | 123/491 |
| 5,233,965 | 8/1993 | Ishikawa et al. | 123/491 |
| 5,289,808 | 3/1994 | Takahashi et al. | 123/421 |

*Primary Examiner*—Raymond A. Nelli
*Attorney, Agent, or Firm*—Fredrikson & Byron

[57] ABSTRACT

In a microprocessor-based electronic engine control system or ECU for electronic fuel injection which determines the amount of fuel to be injected on the basis of engine RPM and throttle opening position, modified by factors derived from sensed conditions of the engine and the environment, a single, long pulse width priming fuel pulse is injected upon cranking the engine. The priming fuel pulse is selected as an inverse function of engine temperature and delivered to the throttle bodies within a first period of time after the engine is initially turned over. The engine revolutions are counted until the engine starts. If the engine fails to reach a predetermined RPM for a predetermined time period (indicating that it has been successfully started) within a certain number of revolutions of the crankshaft, then a second priming pulse is delivered. The pulse width of the second pulse is independent of the pulse width of the first priming pulse but is again dependent on the engine temperature. The sets of first and second pulse widths correlated to engine temperature are preferably stored in ECU look-up table memory.

14 Claims, 4 Drawing Sheets

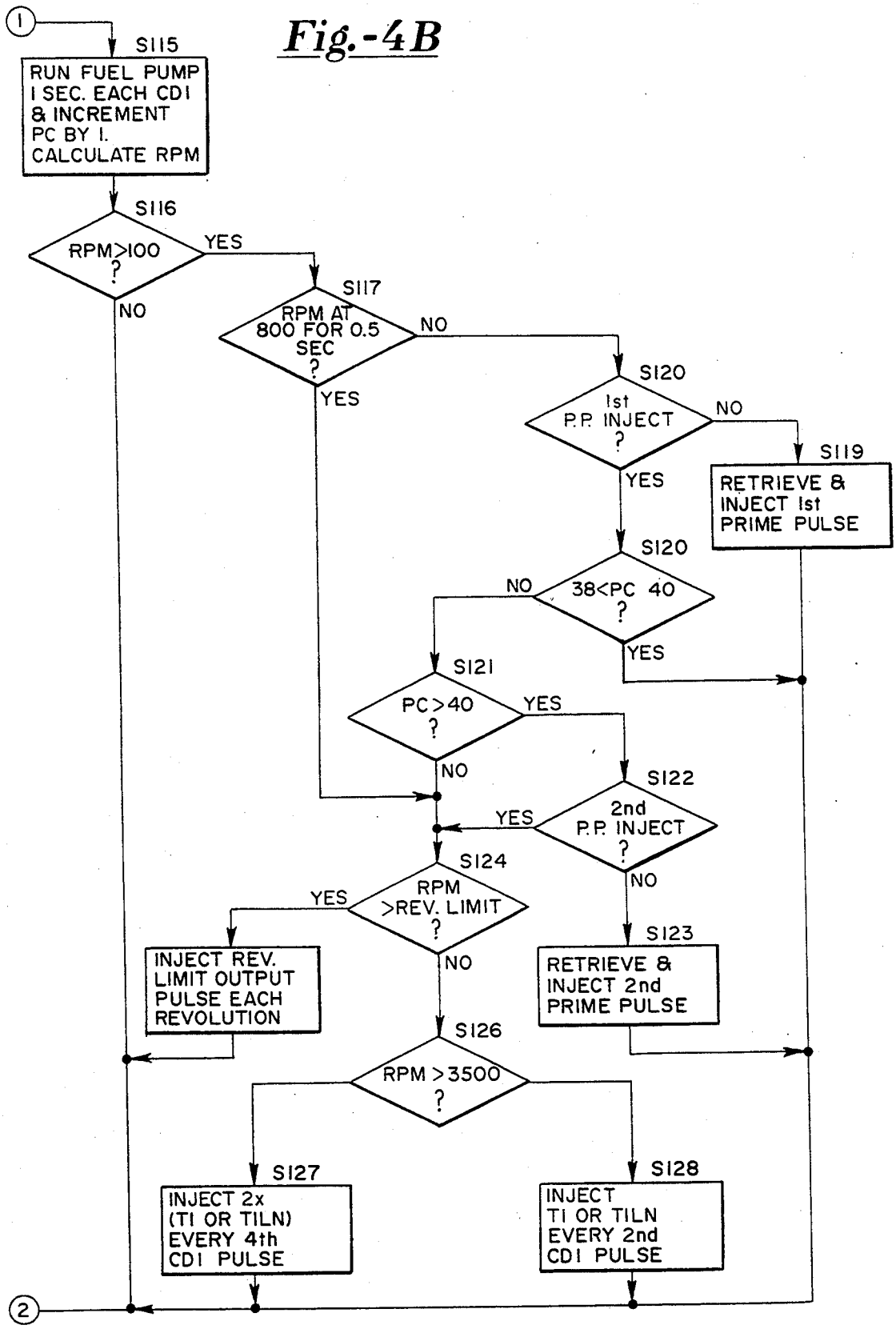
Fig.-4B
1
S115
RUN FUEL PUMP 1 SEC. EACH CDI & INCREMENT PC BY 1. CALCULATE RPM
S116
RPM>100 ?
YES
NO
S117
RPM AT 800 FOR 0.5 SEC ?
NO
YES
S120
1st P.P. INJECT ?
NO
YES
S119
RETRIEVE & INJECT 1st PRIME PULSE
S120
38<PC 40 ?
NO
YES
S121
PC>40 ?
YES
NO
S122
2nd P.P. INJECT ?
YES
NO
S124
RPM >REV. LIMIT ?
YES
NO
INJECT REV. LIMIT OUTPUT PULSE EACH REVOLUTION
S123
RETRIEVE & INJECT 2nd PRIME PULSE
S126
RPM >3500 ?
S127
INJECT 2x (TI OR TILN) EVERY 4th CDI PULSE
S128
INJECT TI OR TILN EVERY 2nd CDI PULSE
2

PRIMING CONTROL SYSTEM FOR FUEL INJECTED ENGINES

BACKGROUND OF THE INVENTION

1. Field of the Invention

The present invention relates to an electronically controlled fuel injection and ignition system for an internal combustion engine, and, more particularly, to such a system providing fuel enriching priming pulses in difficult to start conditions.

2. Description of the Prior Art

Recent advances in microprocessor technology and fuel injection systems for internal combustion engines have enabled the utilization of microprocessor-based electronically controlled ignition timing and fuel injection systems for both two-stroke and four-stroke internal combustion engines. The electronic control unit (ECU) develops fuel injector control signals that control the amount of fuel injected during each revolution of the engine primarily as a function of throttle position and engine RPM and secondarily as a function of engine and ambient condition sensors including the engine temperature, ambient air temperature and barometric pressure. Depending on the variations in air temperature, throttle position, engine RPM, engine temperature, and barometric pressure, each sensor provides a factor which is selectively combined by the software in the electronic control unit to derive a fuel injection pulse width appropriate to the existing conditions. The engine temperature $T_E$ may be the crankcase temperature $T_C$, particularly in two-cycle engines where the fuel-air mixture is scavenged through and warmed by the crankcase, and, in certain systems, engine coolant temperature $T_W$.

The refinement of the algorithms used in such ECU based EFI systems has progressed considerably in the effort to improve starting ability and running at low and high speeds with cold and warm engines and under a wide range of ambient conditions. The operation of a two-cycle snowmobile engine equipped with such a system has been broken down into a number of phases including pre-starting, initial cranking, low speed running or idling after starting is achieved, cranking again if the engine is stopped or dies, acceleration after warm-up, and normal running after engagement of the drive clutch, and specific fuel injection pulse width algorithms have been developed to optimize performance in each phase and to inhibit abuse, e.g. acceleration of a cold engine.

In each of these phases starting with the cranking phase, typically a basic fuel injection pulse width is retrieved from one (or more) stored look-up table or map that provides basic pulse width values as a function of throttle position and engine RPM. The values of the fuel map are pre-programmed in memory and are selected by the ECU software each time the injection pulse width is to be calculated. Factors are derived from the other sensor signal values and are combined mathematically to either add or subtract to the basic pulse width to tailor the fuel/air ratio for the specific air pressure, air temperature and engine temperature to arrive at a corrected fuel injection pulse width. Generally speaking, the basic pulse width is widened for lower altitude, cold engine, cold inlet air, etc., and narrowed for a warm engine, high altitude, and high ambient temperature, etc., in order to maintain the correct fuel/air ratio despite ambient air density changes. Such an electronically controlled fuel injection system is disclosed in U.S. Pat. No. 5,074,271 as well as pending U.S. patent application Ser. No. 603,274, filed on Oct. 25, 1990, entitled FUEL INJECTION CONTROL SYSTEM FOR AN INTERNAL COMBUSTION ENGINE, all incorporated herein by reference.

The above-incorporated '274 application and '271 patent describe such fuel injection systems having parallel, alternate, low speed or "cold engine" fuel map from which a low speed injector pulse width that varies as a function of crankcase temperature is derived. Upon initial cranking to start the engine, the fuel pump will operate for 3–5 seconds to pressurize the injectors. Then a wide pulse width priming fuel quantity or pulse will be delivered by the injectors to aid starting. During the cranking phase and after engine starting, the normal and low speed pulse widths are calculated and injection takes place once during each revolution of the crankshaft or, in certain circumstances, during every other revolution of the crankshaft. The larger of the two pulse widths is used as the injection pulse width. As the engine warms up and time passes, the normal operation employing the normal pulse width takes over. In this fashion, the low temperature, cold engine starting and running fuel injection is enriched.

If, after having started, the engine stalls or is turned off, a timer is started that inhibits the 3–5 second pressurization of the injectors and the delivery of the prime pulse for a time period which is selected to prevent unnecessary priming of a warm engine. Moreover, as described in the '271 patent, a leaner enrichment injection pulse width is employed on restarting a stalled engine to lessen the possibility of flooding.

U.S. Pat. No. 5,038,740 describes priming algorithms that set a supplemental fuel pulse width in accordance with the formula $Ti = Tpre \cdot K_{TA} \cdot Kn$, where Tpre is a basic preliminary injection quantity or pulse width that is related to crankcase temperature, $K_{TA}$ is an air temperature correction coefficient, and Kn is a correction coefficient, shown therein in FIG. 6C, that decreases from 1.0 in direct relation to the number of successive prime pulses delivered. In the '740 patent, the throttle opening is also monitored, and the supplemental enrichment pulses are delivered upon detecting a certain rate of change in the throttle valve occurring a minimum time after the injection of the preceding enrichment pulse, indicating that an attempt to start the engine is being made. As shown in FIG. 7, successive prime pulses are delivered each time the throttle opening rate of change criteria are met, that is, each time the driver tries to manually prime the engine, as if it were carbureted. While each successive enrichment pulse is decreased in width in accordance with Kn to diminish the possibility of flooding, the temperature related basic pulse width Tpre remains the same, and flooding may still occur. Moreover, the supplemental enrichment pulses are delivered in addition to the normal cranking phase fuel injection pulses.

Various other algorithms have been proposed to enhance the likelihood of successful engine starting while trying to avoid flooding. U.S. Pat. No. 5,009,211 provides a system responsive to each of the counted number of kick-start attempts to deliver successively smaller width fuel injection pulses to avoid flooding. These starting pulse widths are derived from a running or normal basic pulse width modified as a function of temperature and pressure factors similar to the algorithms described above but decreased in width as the successive number of kick start attempts increases.

All of these priming and fuel enrichment algorithms for ECU controlled EFI systems for snowmobiles are based on the assumption that the gasoline blend being used remains the same. The cold starting of electronic fuel injected snowmobiles, which may be exposed to extreme temperature ranges and may inadvertently be fueled with "summer blend" gasoline having a low Reed Vapor Pressure (RVP), remains difficult. If the engine fails to start, it has been the practice in some instances to turn the ignition key off or otherwise disconnect the power to the ECU to reset the priming function and to induce another prime pulse which has the same width as the preceding prime and to crank the engine again in the repeated attempt to start it. This attempt to fool the ECU system may cause the engine to flood rather than start, since the second (and subsequent) prime pulse is as wide as the initial prime pulse, and further inconvenience the driver.

SUMMARY OF THE INVENTION

It is accordingly an object of the present invention to provide an improved cold starting priming operation in conjunction with a fuel injection pulse width calculation operation of an electronic controlled fuel injection system to shorten starting time or number of attempts and decrease the possibility of engine flooding.

It is a further object of the present invention to provide an improved cold starting priming operation in conjunction with a fuel injection pulse width calculation operation of an electronic controlled fuel injection system to allow faster starts at low temperatures with summer blend or poor quality fuel.

These and other objects are achieved in accordance with the invention in an electronic controlled fuel injection system of the type described above that delivers a first priming fuel pulse having a pulse width related to engine temperature during the initial cranking phase, and, if the engine fails to start, delivers a second priming fuel pulse, also having a pulse width dependent on engine temperature, after a predetermined number of engine revolutions are counted.

Moreover, the first and second priming pulses are preferably separately dependent on engine temperature wherein the set of pulse widths for the second priming fuel pulse can be narrower than the set of pulse widths for the first priming pulse except within a middle temperature range between extreme cold and warm engines.

More particularly, in an internal combustion engine having a fuel injection system responsive to a fuel control signal for injecting a controlled quantity of fuel and air into each combustion chamber of the engine, an intake passage having a throttle valve arranged to close and open the intake passage in varying degrees to provide air to the engine to sustain combustion, an ignition system for igniting the fuel/air mixture in each combustion chamber of the engine, and an electronic control unit for developing the fuel control signal, an improved cold start priming operation is provided which operates by: generating a first signal related to the revolution of the engine during an attempt to start the engine; measuring the engine temperature; retrieving a first prime pulse width from a first look-up table in dependence on the measured temperature of the engine; injecting a first prime pulse of fuel having the first pulse width dependent on the measured engine temperature; counting the first signals during the continued attempt to start the engine; retrieving from a second look-up table a subsequent prime pulse width having a further pulse width dependent on the measured temperature for enhancing the possibility of starting the engine; and, injecting the second prime pulse of fuel.

In a preferred embodiment, the improved priming operation further comprises storing sets of first and subsequent prime pulse widths as look-up tables correlated to engine temperature and retrieving the appropriate pulse width from the appropriate look-up table to employ it in the priming operation.

The improved fuel injection control apparatus and method preferably further calculates the running engine fuel injection pulse widths for both normal and low engine temperature conditions through retrieval of stored normal and low engine temperature basic fuel injection fuel quantity values correlated to engine revolution rate and throttle opening and modifying the retrieved values by a coefficient calculated from factors derived from various sensors of conditions that influence engine operation.

The invention enhances starting ability of fuel injected engines operating under extremes of engine temperature through precise control of priming pulse widths selected as a function of temperature and particular characteristics of the engine and fuel injection system.

BRIEF DESCRIPTION OF THE DRAWINGS

These and other objects, advantages and features of the present invention will become apparent from the following detailed description of the preferred embodiments thereof in conjunction with the drawings in which:

FIGS. 4A and 4B are a flow chart of an algorithm implemented in the ECU for controlling the delivery of the appropriate fuel injection priming pulse in accordance with the engine starting conditions and the engine temperature.

DETAILED DESCRIPTION OF THE PREFERRED EMBODIMENTS

The improved engine control system and method of the present invention is especially adapted for use in an electronically controlled, fuel injected, two cylinder, two-stroke engine of the type used, for example, in the INDY 500 SP high performance snowmobile manufactured by Polaris Industries L.P. and employing an electronic fuel injection system operated by an ECU of the type described in the above-incorporated '274 application. In such engines, a quantity of fuel is injected simultaneously into the two individual throttle bodies for the two cylinders downstream from the two butterfly type throttle valves. The throttle valves are coupled together and to a throttle opening degree sensor and air box, so that an air/fuel mixture is created in the throttle bodies, and the mixture in each throttle body is drawn into the combustion chambers of the two cylinders through a crankcase scavenging action in a fashion known in the art.

Figure 1:
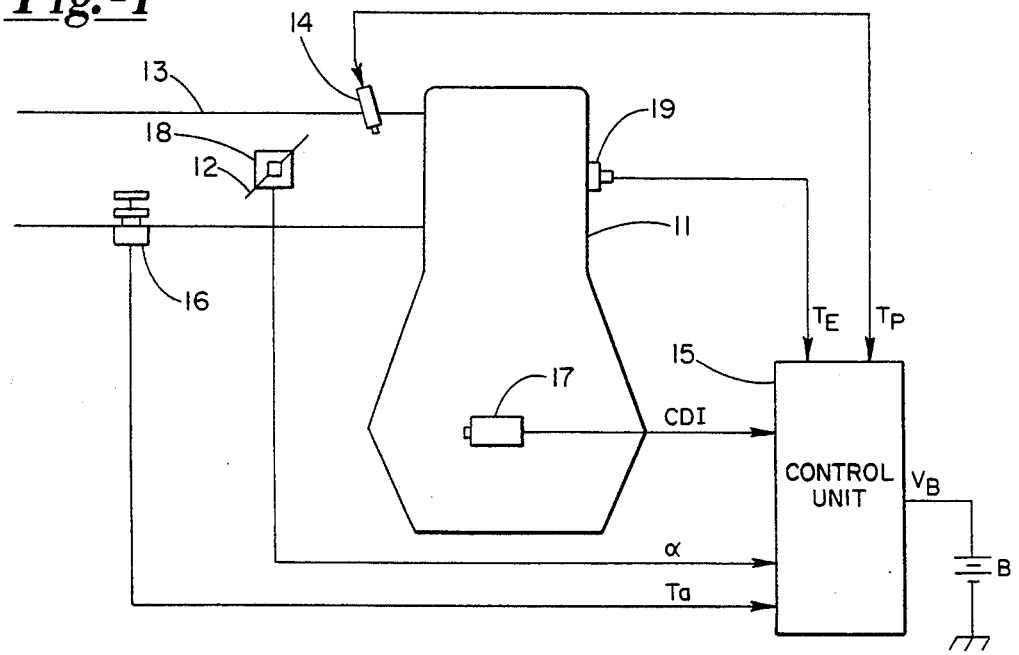
FIG. 1 is a simplified schematic illustration of an internal combustion engine equipped with sensors and an electronic control unit (ECU) for electronic fuel injection (EFI)
Figure 2:
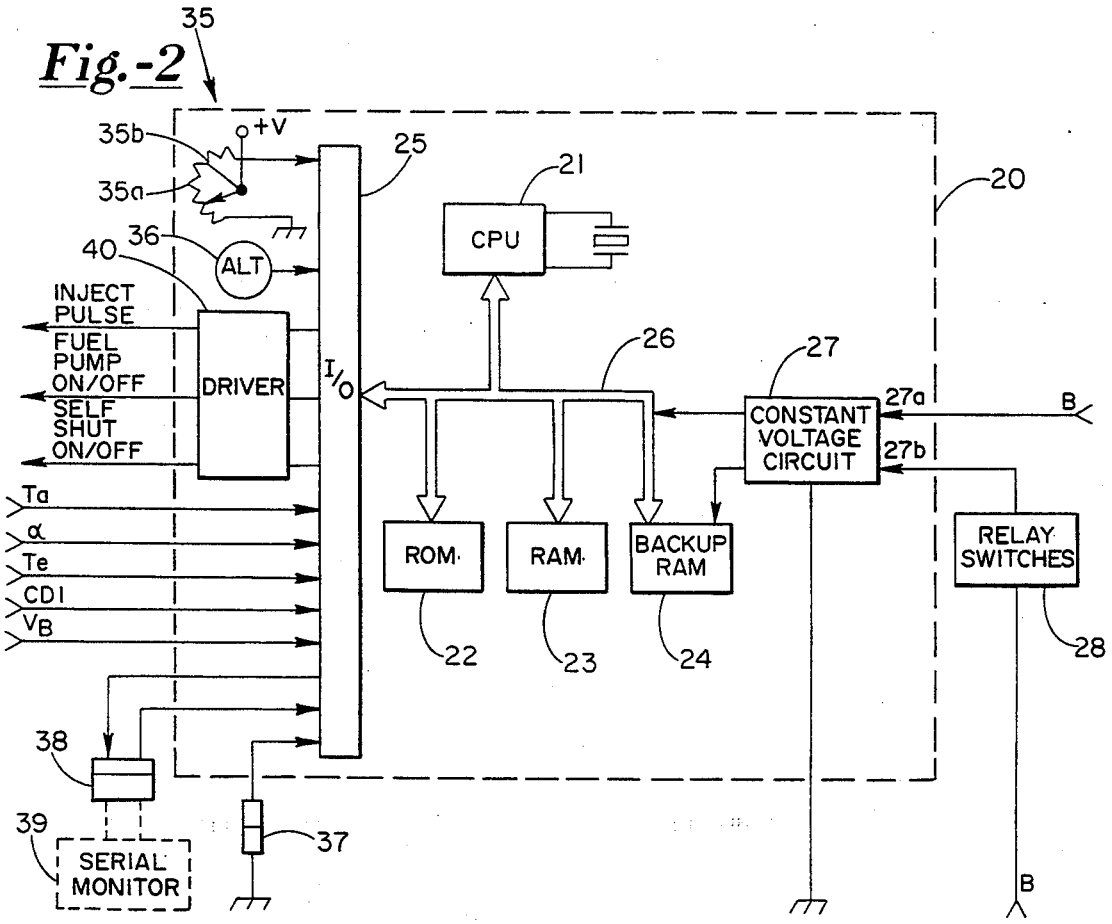
FIG. 2 is a block diagram of an ECU for an EFI system.

Referring now to FIG. 1, it illustrates a simplified EFI equipped snowmobile engine, and particularly the sensors and sensor input signals to the control unit 15, as depicted as FIG. 2 of the above-incorporated '740 patent. The crankcase 11 of the engine has a manifold or throttle body 13 which is connected at its open end to an air box and filter and is connected to the crankcase 11. Fuel is injected into the throttle body during the pulse time period that the fuel injector 14 is energized by the engine control unit 15. Air is allowed into the throttle body to mix with the fuel pulse by the opening of the throttle valve 12 by the driver. The fuel pulse is injected at a predetermined point in the revolution of the crankshaft.

As described above and in the above-incorporated patents and application, the injection pulse width is calculated by the engine control unit 15 as a function of engine RPM and throttle opening position derived from a fuel map, modified by coefficients derived from sensor output signals. The engine speed N in RPM is derived from the time interval between successive CDI signals generated by a crankshaft rotation sensor 17 at a predetermined point in the rotation of the crankshaft in a manner described hereafter. The throttle position sensor 18 develops a throttle opening angle signal $\alpha$ which is employed with the engine speed N to derive the basic fuel injection pulse width Tp. An air temperature sensor 16 and an engine temperature sensor 19, supply signals $T_A$ and $T_E$, respectively, to the control unit 15 which are employed to develop correction coefficients as described below. In certain configurations, the engine temperature signal $T_E$ may be one or both of the engine crankcase temperature and the engine water temperature sensed by appropriate sensors which develop respective output signals $T_C$ and $T_W$.

The battery B is also connected to the engine control unit 15 (under certain starting and operating conditions described hereafter) to both provide operating power and so that its operating voltage $V_B$ may be employed in the calculation of the actual fuel injection pulse width. The engine control unit 15 includes the electronic control unit (ECU) as well as other components including a pulse detecting circuit responsive to the crankshaft rotation sensor signal R.

The ECU 20 is depicted in FIG. 2 and corresponds to FIG. 1B of the above-incorporated U.S. patent application Ser. No. 603,274. The ECU 20 is a microprocessor-based system including a Central Processing Unit (CPU) 21, a ROM 22, a RAM 23, a backup RAM 24 and an input/output interface 25, which are connected to each other through a bus 26.

A regulated voltage for powering the other components of the ECU 20 is provided by a constant voltage circuit 27. Constant voltage circuit 27 is directly connected to the battery B at all times at terminal **27*a* for the limited purpose of powering the back-up RAM 24 to maintain the stored data when the key switch is turned off. The battery B is separately applied to a further input 27*b* of the constant voltage circuit 27 through a set of relay switches 28 thaqt are closed: (1) when the ignition and kill switches are both "on" or closed during starting and running of the engine; and (2) for a self-shut-off time period started when the ignition switch and/or the kill switch is/are turned "off" after the engine has been running, as described in the above-incorporated '274 application. The self-shut-off relay state is controlled by the ECU 20**.

The CPU 21 also receives the sensor input signals described above and provides control signals to the EFI system through the I/O interface 25. Connectors 37 and 38 are employed with serial monitor 39 in self-diagnostic functions described in detail in the above-incorporated '274 patent application.

An altitude dependent atmospheric pressure signal ALT is provided by an atmospheric pressure sensor 36 through the I/O interface 25. Furthermore, a manually adjustable variable "MR" potentiometer **35*a*, 35*b* is connected to a regulated voltage to apply a voltage to the CPU 21 through the I/O interface 25 which responds by adjusting the enrichment fuel/air ratio below a certain engine speed, e.g. 3500 RPM. The adjustment of the MR potentiometer wiper 35*b*** takes into account variables in engine characteristics due to cumulative manufacturing tolerances and may also be made as necessary to enrich or lean the fuel/air ratio to account for variations in available fuel volatility and high altitudes.

The battery voltage level $V_B$ is monitored through I/O interface 25 when the key switch and kill switch are both "on". When the voltage of the battery B decreases, the effective injection pulse width actually provided by the injector reduces. In order to correct the reduction of the pulse width, an injector voltage correcting operation is provided in the CPU 21. The injector voltage correcting operation employs a look-up table (not shown) storing a plurality of invalid pulse widths in accordance with the terminal voltage $V_B$ of the battery. The invalid pulse width is a period of time within which fuel is not injected although the voltage $V_B$ is applied to the injector. An injector voltage correcting width $T_S$ corresponding to the invalid pulse width is retrieved from a look-up table in ROM 22.

The engine and air temperature sensors 19 and 16 are connected to the I/O interface 25 which supplies these sensors with a low voltage signal. The temperature sensors develop modulated low voltage signals $T_A$ and $T_E$ (which may be $T_C$ and/or $T_W$ as described above), respectively.

The CPU 21 reads the values of the ALT, $V_B$, $T_A$ and $T_E$ signals as well as the voltage setting of the MR potentiometer wiper and employs them in accordance with software loaded in RAM 22 to develop correction coefficients or K factors (collectively referred to hereafter as "COEFF") to modify the basic injection pulse width Tp.

The actual calculation of each correction coefficient is set forth in greater detail in the above-incorporated '274 application, and is not itself material to the subject matter claimed herein. Reference is therefore made to the '274 application for a description of a manner in which the sensor output signals can be employed to first retrieve corresponding correction coefficient or K factors from look-up tables for each stored in ROM 22 and how the K factors are multiplied together to derive the COEFF.

The '274 application also describes in greater detail how properly timed ignition is provided to the cylinders of the engine as a function of detected crank angle. Through further circuitry shown in FIGS. 2 and 3 of the '274 patent application, a CDI pulse signal is developed each time the engine rotates through 180° and is applied to the ECU 20. Every second CDI signal is employed as engine revolution signal R and to derive the engine RPM. A cycle f is obtained from a time interval T180° between each CDI pulse in accordance with:

$$f = dT180°/d\Theta 180°$$

The engine speed N is calculated based on the cycle f as follows.

$$N = 60/(2\pi \cdot f)$$

The engine speed N and the throttle opening degree $\alpha$ detected by the throttle position sensor are employed by the CPU 21 to retrieve the basic fuel injection pulse width Tp. The basic fuel injection pulse width Tp, the combined correction coefficient COEFF and the injector voltage correcting width Ts are combined in a fuel injection pulse width calculation operation where the actual injection pulse width Ti is calculated as follows:

$$Ti = Tp \times COEFF + Ts$$

Similarly, the parallel low temperature injection pulse width Tiln is calculated as described in the above-incorporated '271 patent and '274 application. The pulse width Ti or Tiln is applied to each fuel injector through a driver 40 at a predetermined time in the revolution of the crankcase. Output ports of the interface 25 are connected to the driver 40 which in turn is connected to the fuel injectors and the fuel pump to operate the fuel pump when the CPU 21 is coupled to battery voltage $V_B$ and to energize the fuel injector solenoids for the injection pulse width Ti or Tiln once during every revolution of the engine greater than a certain selected engine speed, e.g. 3500 RPM. At engine speeds below the selected engine speed, the calculated pulse width is doubled and the injection frequency is halved.

The driver 40 also is connected to a self-shut-off relay and a fuel pump also shown and described in the above-incorporated '274 patent application. The fuel pump is operated periodically during running of the engine and for 3–5 seconds upon initial cranking of the engine unless it has previously run during a prior start attempt or running period within the time out period of the self shut-off relay. The self-shut-off relay is wired between the battery B and the constant voltage circuit 27 and is turned on by an output signal from driver 40 for a period, e.g. ten minutes, to supply power to the ECU for that period if the engine is stopped or if cranking to start the engine is halted. The priming algorithm is disabled for that time period so that priming pulses are not calculated or delivered during any attempt to start or restart the engine during the period.

Figure 4A:
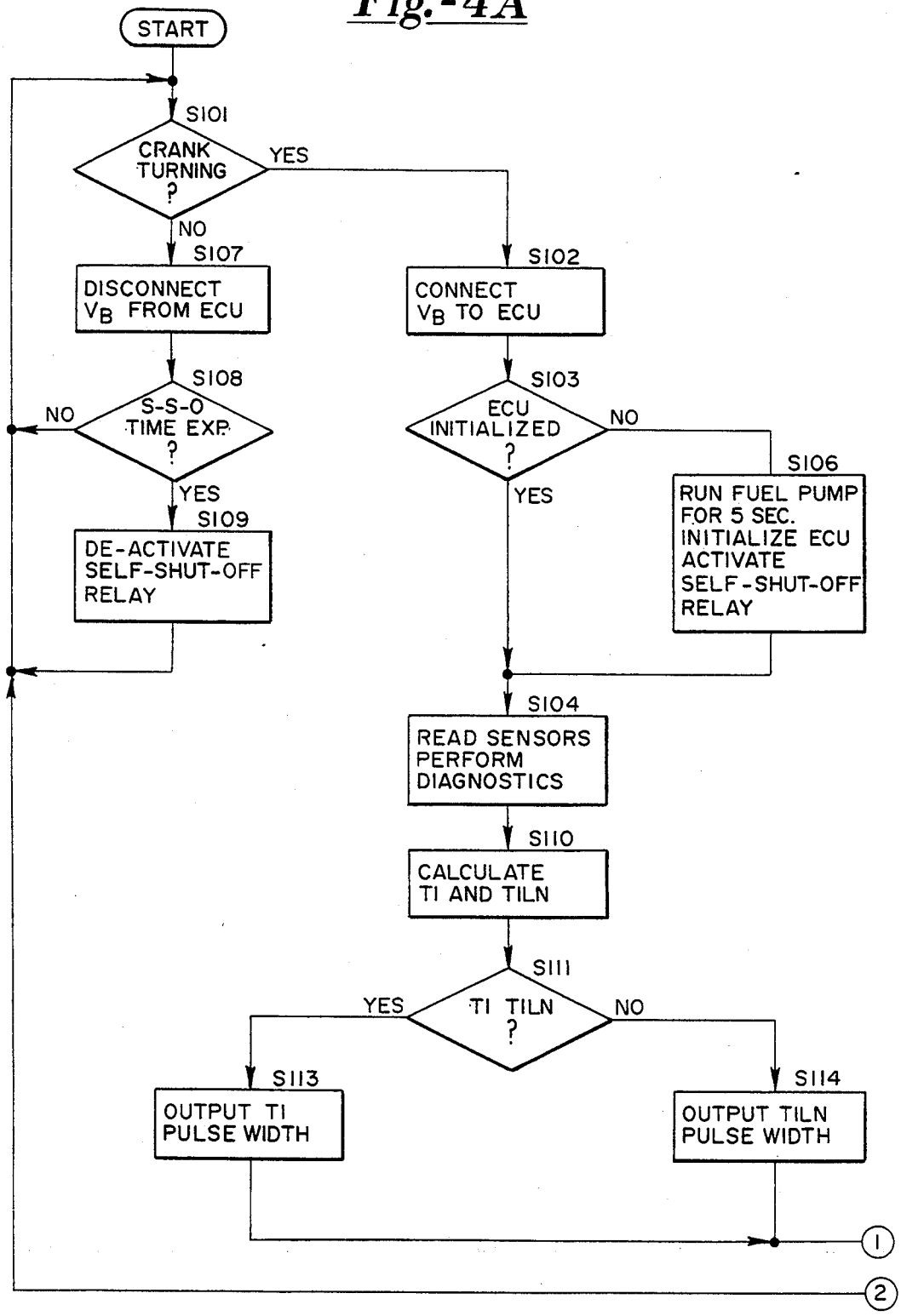

In accordance with the present invention, first, second and even further look-up tables that contain priming pulse widths Tpri selected as a function of engine temperature $T_E$ (which may be engine crankcase and/or water temperatures) are also stored in ROM 22 and accessed in accordance with the engine starting algorithm illustrated in the flow chart of FIGS. 4A and 4B. The algorithm is stored as software in ROM 22.

Figure 3:
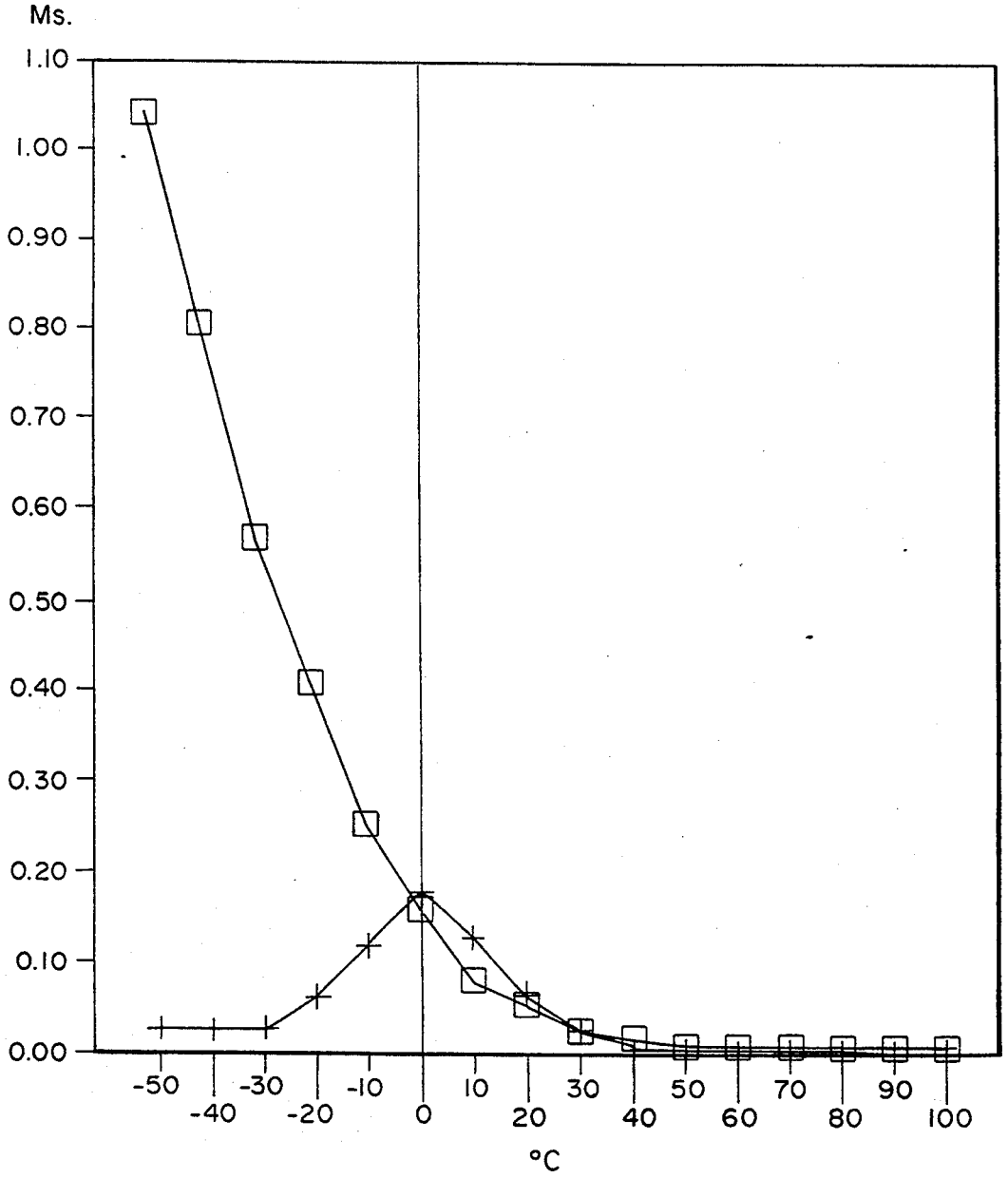
FIG. 3 is a graph depicting the relationship between engine temperature and first and second priming pulse width values.

FIG. 3 illustrates in graphic form first and second sets of $Tpri_1$ and $Tpri_2$ values (in milliseconds) dependent on engine temperature $T_E$ (in degrees Centigrade) and the counted number PC of engine CDI pulses R which, when counted during a single starting attempt (or a number of attempts made within a certain time period), match a set of threshold counts $TC_n$. In other words, when $PC = TC_n$, the $Tpri_n$ value corresponding to $T_E$ is selected. Exemplary values for the sets of first and second priming pulse widths, $Tpri_1$ and $Tpri_2$, over a range of engine temperatures illustrated in FIG. 3 are set forth in the following table:

| TEMP (C.°) | $Tpri_1$ | $Tpri_2$ |
|---|---|---|
| −50 | 1044.5 | 24.6 |
| −40 | 806.9 | 24.6 |
| −30 | 569.3 | 24.6 |
| −20 | 409.6 | 61.4 |
| −10 | 254.0 | 118.8 |
| 0 | 159.7 | 180.2 |
| 10 | 81.9 | 131.1 |
| 20 | 53.2 | 65.5 |
| 30 | 24.6 | 24.6 |
| 40 | 16.4 | 8.2 |
| 50 | 8.2 | 4.1 |
| 60 | 8.2 | 4.1 |
| 70 | 8.2 | 4.1 |
| 80 | 8.2 | 4.1 |
| 90 | 8.2 | 0.0 |
| 100 | 8.2 | 0.0 |

The method of operation of the system of the present invention for selecting and delivering the appropriate pulse width priming pulse is described hereinafter with reference to the flow chart of FIGS. 4A and 4B. It is presumed that the kill and ignition key switches are in the "run" positions and the engine is cranking at the BEGIN step in FIG. 4A. At step S101, engine cranking is detected, and battery voltage is connected to the ECU 15 at step S102. In this state, the battery voltage level $V_B$ and the CDI pulses are applied to the I/O block 25 in FIG. 2.

At step S103, the ECU initialization state is checked, and if initialization has taken place due to an earlier starting attempt, then diagnostic tests and sensor output signal values are read in block S104. If not, then the fuel pump is run in step S105 until 5 seconds elapses and the ECU is initialized. The self-shut-off relay is also activated in step S105 on initialization of the ECU. Again, the sensor output signal values are read and diagnostic tests are performed in block S104.

Referring back to step S101, when cranking ceases (indicating either that the engine has failed to start or has been intentionally killed), the sensed battery voltage $V_B$ is disconnected from the ECU in block S107. However, battery voltage is applied to constant voltage circuit 27 to power the ECU 20 for the remaining duration of the self-shut-off time as described above with respect to FIG. 2. The time-out of the self-shut-off time is checked in step S108, and the relay is deactivated in step S109 when the time has expired. Until the self-shut-off time has expired, the state of the crankshaft continues to be monitored in step S101.

In step S104 the engine temperature $T_E$, RPM and the other sensor variables are read for use in selecting the appropriate Tpri value in the priming operation and for use in calculating the running fuel injection pulse width coefficients and modifiers. In step S110, the running pulse widths Ti and Tiln are calculated from the throttle opening degree $\alpha$, the engine RPM and other sensor derived coefficients in the manner described above. In steps S111–S113, Ti and Tiln are compared, and the larger is selected for the reasons described above and in the above-incorporated '271 patent and '274 application. However, no injection occurs unless engine RPM exceeds a minimum running speed, e.g. 100 RPM.

As the engine is turned over in attempting to start it, the CDI pulses are detected in step S101. Engine revolutions R are detected from the CDI pulses, and engine speed N is calculated based on the calculated cycle f ($N=60/2\pi \cdot f$) in step S115 in FIG. 4B. Also in step S115, the count in the CDI pulse counter is incremented by "1", and a signal is generated to operate the fuel pump for one second. Since CDI pulses of a running engine recur at intervals shorter than one second, the fuel pump is effectively operated constantly during running until one second elapses from the last CDI pulse.

At step S116, the engine speed N (in RPM) is compared to a threshold, e.g. 100 RPM, selected to be within the cranking range and well below the engine idle speed running threshold. If engine speed N exceeds the 100 RPM threshold, the engine is presumed to be cranking, and the speed N is checked against a sustained higher engine speed threshold of 800 RPM for 0.5 seconds in decision block S117. Once that threshold is met, the engine is presumed to have started.

Assuming that the engine is not being restarted during the self-shut-off time period, it is necessary to calculate and deliver the appropriate first wide pulse width priming pulse $Tpri_1$. When the ECU is initialized in step S106, a priming pulse delivered count is reset to indicate that no priming pulse has been delivered in the current starting cycle or a preceding cycle terminated within the time window set by the self-shut-off timer. In step S118, the status of the priming pulse delivered count is checked. If the initial pulse has not been delivered, then the initial prime pulse is calculated and injected in step S119 at the first ignition pulse. If it has been delivered, then the second prime pulse $Tpri_2$ is to be calculated and delivered in steps S120–S123 a certain number of engine revolutions later.

The initial prime pulse is delivered shortly after cranking commences, whereas the second prime pulse is delivered after cranking continues unsuccessfully and a certain ignition pulse count is reached. The pulse counter value PC is incremented in step S115 by each ignition pulse, and the count is compared to a minimum and a maximum value in step S120, e.g. $38 \leqq PC \leqq 40$. When the PC count satisfies this comparison, fuel injection of the pulse Ti or Tiln calculated in steps S110–S113 is inhibited until the count exceeds the maximum value, 40 in this example.

When the count PC equals or exceeds 40 in step S121 and it is determined that the second prime pulse has not been delivered in step S122, the second prime pulse $Tpri_2$ is calculated and delivered in step S123 in substitution for the normal or low temperature fuel injection pulse widths. Both prime pulse widths are derived from the look-up tables illustrated, for example, in FIG. 3 as a function of engine temperature as described above.

During the starting phase, the appropriate fuel injection pulses are delivered using the wider of the normal and low temperature pulse widths Ti and Tiln as determined in steps S110–S113 once each engine revolution. After starting is detected in step S117 or the count reaches or exceeds 40 in step S121 or the second prime pulse is delivered in steps S122 and S123, the engine speed N is compared to an RPM "redline" value in step S125. If the engine is over-revving, then a specific, overly rich, engine RPM limiting pulse width is used in step S125.

If engine speed is appropriate but greater than 3500 RPM, the calculated output pulse width is utilized, and fuel injection pulses are delivered once during each engine revolution in step S128. However, if engine speed is below 3500 RPM, then the calculated pulse width is doubled but the fuel pulses are delivered only once every other revolution of the engine in step S127. Assuming a two cylinder engine, each engine revolution corresponds to two successive CDI pulses so that the calculated pulse widths are delivered once every fourth CDI pulse in step S127 and once every second CDI pulse in step S128. These steps S127 and S128 are a simplification of the steps set forth in allowed U.S. patent application Ser. No. 07/602,959 to FUEL INJECTION CONTROL SYSTEM FOR A TWO-CYCLE ENGINE filed Oct. 25, 1990 and incorporated herein by reference in its entirety.

If the engine fails to start at step S117 and after delivery of both prime pulses, then no further prime pulses can be delivered until cranking ceases and the self-shut-off relay timer times out. Cranking may be continued and the engine may or may not start before the attempt is abandoned.

It will be understood that this algorithm may be employed in conjunction with the algorithm disclosed in the above-incorporated '271 patent dealing with successive starting and restarting operations and may also be employed with the detection of a certain throttle opening operation as disclosed in the above-incorporated '740 patent. In the latter case, the requisite throttle opening detection to trigger delivery of the priming pulse may be employed after steps S118 and S122 in the flow chart of FIG. 4B.

The above described features of the invention may be realized and implemented in other types of engines than two cylinder, two-stroke engines. Four-stroke, multicylinder engines with direct fuel injection into the cylinders may, for example, benefit from incorporation of the prime pulse width method of the present invention.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. In an internal combustion engine having a fuel injection system responsive to a fuel injection control signal for injecting a controlled quantity of fuel and air into each combustion chamber of the engine, an intake passage having a throttle valve arranged to close and open the intake passage in varying degrees to provide air to the engine to sustain combustion, an ignition system for igniting the fuel/air mixture in each combustion chamber of the engine, and an electronic control unit for developing the fuel injection control signal, apparatus for providing a priming fuel quantity injection control signal comprising:

detecting means for generating a first signal related to the revolution rate of the engine;

means for sensing a value of an ambient condition;

means for establishing a threshold reflecting a revolution rate of an engine during cranking below a minimum running idle speed of said engine;

memory means for storing at least first and second sets of priming fuel quantities wherein the quantities of each set vary as a function of the sensed ambient condition;

first selecting means operable when the revolution rate of the engine is below said revolution rate threshold for selecting a first priming fuel quantity corresponding to said sensed value of said ambient condition from said first set of priming fuel quantities;

means for providing a count related to said revolution rate of said engine when the revolution rate of the engine remains below said revolution threshold;

second selecting means operable when the count achieves a predetermined value for selecting a second priming fuel quantity related to said sensed value of said ambient condition; and means responsive to the first and second priming fuel quantities for providing first and second respective priming fuel injection control signals to said fuel injection system.

2. The apparatus of claim 1 wherein:

said threshold means is operable for establishing a second threshold count;

said memory means stores a further set of priming fuel quantities that vary as a function of a further sensed value of an ambient condition;

said second selecting means is operable for sensing said actual value of said ambient condition and selecting said priming fuel quantity corresponding to said sensed value of said ambient condition when said count of said revolution sensing means matches said second threshold count; and said priming fuel quantity setting means is operable for providing said priming quantity control signal as a function of said second selected quantity representative thereof.

3. The apparatus of claim 2 wherein said memory means further comprises at least first and second fuel maps of priming quantity values correlated to said sensed values of said ambient condition.

4. The apparatus of claim 3 wherein said sensed ambient condition is the engine temperature.

5. The apparatus of claim 1 wherein said electronic control unit further comprises:

second memory means for storing a set of basic fuel injection fuel quantity values as a second look-up table correlated to engine revolution rate and throttle opening values; and means responsive to said engine revolution rate exceeding said engine speed threshold value for retrieving said appropriate basic fuel injection fuel quantity value from said second memory means; and wherein:

said fuel injection quantity setting means is operable for employing said retrieved value in said control of said fuel injection system.

6. In an internal combustion engine having a fuel injection system responsive to a fuel control signal for injecting a controlled quantity of fuel and air into each combustion chamber of the engine, an intake passage having a throttle valve arranged to close and open the intake passage in varying degrees to provide air to the engine to sustain combustion, an ignition system for igniting the fuel/air mixture in each combustion chamber of the engine, and an electronic control unit for developing the fuel injection control signal, an improved method for providing a priming fuel quantity injection control signal during the starting of the engine comprising the steps of:

storing first and second sets of priming fuel quantity values that vary as a function of a set of values of a sensed ambient condition;

calculating a revolution rate of the engine;

establishing a threshold signal reflecting a revolution rate of an engine that has not started and is below a minimum idle speed of said engine;

sensing a value of an ambient condition affecting the starting of said engine;

selecting said first priming fuel quantity value corresponding to said sensed value of said ambient condition from said first set of stored priming fuel quantity values;

injecting a first fuel injection prime pulse corresponding to said first priming fuel quantity value;

selecting said second priming fuel quantity corresponding to said sensed value of said ambient condition, if said engine revolution rate remains below said threshold, from said second set of stored priming fuel quantity values; and injecting a second fuel injection prime pulse corresponding to said second priming fuel quantity value.

7. The method of claim 6 further comprising the steps of:

storing a further set of priming fuel quantities that vary as a function of a further set of values of a sensed ambient condition; and sensing an actual value of the ambient condition and selecting said priming fuel quantity corresponding to said sensed value of said ambient condition when a count of the revolution sensing means matches said second threshold count; and providing said priming quantity control signal as a function of said second selected quantity representative thereof.

8. The method of claim 7 wherein said storing step further comprises storing a fuel map of priming quantity values correlated to engine revolution threshold counts and to values of said sensed ambient condition.

9. The method of claim 7 wherein said sensed ambient condition is the engine temperature.

10. The method of claim 6 wherein said operation of said electronic control unit further comprises said steps of:

storing a set of basic fuel injection fuel quantity values as a second look-up table correlated to engine revolution rate and throttle opening values;

retrieving said appropriate basic fuel injection fuel quantity value from said second look-up table in response to said engine revolution rate exceeding said engine speed threshold value; and employing said retrieved value in said control of said fuel injection system.

11. In a microprocessor-based electronic engine control system for electronic fuel injection which determines the amount of fuel to be injected on the basis of engine RPM and throttle opening position, modified by factors derived from sensed conditions of the engine and the environment, an improved priming control method comprising the steps of:

storing first and second sets of fuel enrichment priming pulse widths correlated to engine temperature within a range of engine temperatures;

detecting engine speed;

detecting engine temperature when detected engine speed exceeds a cranking speed threshold;

retrieving a pulse width from said first set of pulse widths corresponding to said detected engine temperature;

injecting a first priming fuel pulse having a retrieved pulse width upon cranking said engine at a detected low engine speed and within a first period of time after said engine is initially turned over;

counting engine revolutions until said detected engine speed exceeds an engine start threshold;

retrieving a pulse width from said second set of pulse widths corresponding to said detected engine temperature when said engine revolution count exceeds a certain threshold; and injecting a second priming fuel pulse having said retrieved pulse width during cranking of said engine at a detected low engine speed and when said engine revolution count exceeds said predetermined threshold.

12. The improved method of claim 11 wherein said first and second sets of priming pulse widths are independently variable in dependence on said engine temperature.

13. In a microprocessor-based electronic engine control system for electronic fuel injection which determines the amount of fuel to be injected on the basis of engine RPM and throttle opening position, modified by factors derived from sensed conditions of the engine and the environment, an improved priming control apparatus comprising:

means for storing first and second sets of fuel enrichment priming pulse widths correlated to engine temperature within a range of engine temperatures;

means for detecting engine speed;

means for detecting engine temperature when detected engine speed exceeds a cranking speed threshold;

means for retrieving a pulse width from said first set of pulse widths corresponding to said detected engine temperature;

means for injecting a first priming fuel pulse having a retrieved pulse width upon cranking said engine at a detected low engine speed and within a first period of time after said engine is initially turned over;

means for counting engine revolutions until said detected engine speed exceeds an engine start threshold;

means for retrieving a pulse width from said second set of pulse widths corresponding to said detected engine temperature when said engine revolution count exceeds a certain threshold; and means for injecting a second priming fuel pulse having said retrieved pulse width during cranking of said engine at a detected low engine speed and when said engine revolution count exceeds said predetermined threshold.

14. The apparatus of claim 13 wherein said first and second sets of priming pulse widths are independently variable in dependence on said engine temperature.

* * * * *